US006647988B2

(12) United States Patent
Christianson

(10) Patent No.: US 6,647,988 B2
(45) Date of Patent: Nov. 18, 2003

(54) NAIL CARE SYSTEM

(75) Inventor: Tristan M. Christianson, San Francisco, CA (US)

(73) Assignee: Sharper Image Corporation, San Francisco, CA (US)

( * ) Notice: Subject to any disclaimer, the term of this patent is extended or adjusted under 35 U.S.C. 154(b) by 86 days.

(21) Appl. No.: 09/821,239

(22) Filed: Mar. 29, 2001

(65) Prior Publication Data

US 2002/0139382 A1 Oct. 3, 2002

(51) Int. Cl.[7] ..... A45D 29/18; A45D 29/00
(52) U.S. Cl. ..... 132/73.5; 132/73
(58) Field of Search ..... 132/73.5, 73, 75, 132/76.5, 286; 34/66, 202, 20, 13, 90

(56) References Cited

U.S. PATENT DOCUMENTS

| | | | | | |
|---|---|---|---|---|---|
| 2,184,858 | A | * | 12/1939 | Goodman | 132/73.5 |
| 2,260,687 | A | * | 10/1941 | Lasha | 132/73.5 |
| 2,490,019 | A | * | 12/1949 | Elliot | 132/73.5 |
| 3,563,252 | A | * | 2/1971 | Spohr | 132/73.5 |
| 3,643,346 | A | * | 2/1972 | Lester | 34/202 |
| 3,667,134 | A | * | 6/1972 | Rockson | 34/202 |
| 4,255,871 | A | * | 3/1981 | Sigman | 34/243 |
| 4,754,769 | A | * | 7/1988 | Flynn | 132/73.5 |
| 5,111,594 | A | * | 5/1992 | Allen | 34/202 |
| 5,130,551 | A | * | 7/1992 | Nafziger et al. | 250/492.1 |
| 5,280,679 | A | * | 1/1994 | Edelman | 34/66 |
| 5,442,867 | A | * | 8/1995 | Robinson | 34/90 |
| 6,035,545 | A | * | 3/2000 | Jones | 34/202 |
| D431,682 | S | * | 10/2000 | Seo | D28/54.1 |
| 6,128,826 | A | * | 10/2000 | Robinson | 34/90 |
| 6,189,230 | B1 | * | 2/2001 | Huen | 34/90 |
| D442,742 | S | * | 5/2001 | Suen | D28/61 |

OTHER PUBLICATIONS

U.S. patent application Ser. No. 29/140,318, Tristan M. Christianson, filed Apr. 16, 2001.
Lifestyle *Fascination* Summer 2000 Catalog, Item No. RAZ201, StyleSpa™ Professional Manicure Kit, 2 pages.
The Sharper Image Nov. 2000 Catalog, Item No. HF810, Professional Nail System for Manicures and Pedicures, 2 pages.

* cited by examiner

*Primary Examiner*—John J. Wilson
*Assistant Examiner*—Robyn Kieu Doan
(74) *Attorney, Agent, or Firm*—Fliesler Dubb Meyer & Lovejoy LLP

(57) ABSTRACT

A nail care system which contains a portable case, drying compartments and drying compartment covers. The drying compartments are vertically oriented on opposite sides of the portable case. The drying compartment covers are pivotally mounted to the portable case and open and close like a gull-wing type door. The vertically oriented drying compartments allow the user to place their hands in a comfortable, vertical position in front of them during the drying process. The vertical orientation also reduces the footprint of the portable case. Further, the nail care device may be adapted to dry toenails.

20 Claims, 5 Drawing Sheets

NAIL CARE SYSTEM

FIELD OF THE INVENTION

The present invention relates generally to a portable case which has compartments that a user may place their hands within to dry their hands. More particularly, the present invention is a nail care system where a user, after painting their nails, may dry their nails by placing their hands in a vertical orientation and into the drying compartments.

BACKGROUND

The provision of nail care services to individuals in the past has required the individual to visit a nail care salon which in general is remote from the normal activity of the individual. Not only is travel time and parking a problem, with respect to the provision of nail care services, the length of time required for such services as manicures, the sculpting and painting of nails, and provision of acrylic nails, tips or fills is also a problem.

Instead of taking the time to travel to a salon which provides nail care services, many people take care of their nails at home. The process of allowing painted nails to dry consumes a large portion of the time required to care for the nails. Thus, typical nail care devices provide a drying unit for a user to place their nails within to accelerate the drying process.

However, the drying portion of the typical nail care system requires the user to place their hands horizontally under the dryer. Such an arrangement requires a large footprint by the nail care device, requiring the user to clear a large space on a table to fit the device. As the nail care device is meant to be portable, the device should also be easy to set up and put away when finished.

Therefore, there is a need for a hand or nail drying device that allows a user to place their hands comfortably in front of them while drying their hands or nails. Further, the device should be compact so that a user may easily store the device when it is not in use.

SUMMARY OF THE INVENTION

The present invention is a nail care system that contains a portable case with integrated drying compartments. Preferably, the portable case has two vertically oriented drying compartments.

The vertical orientation is beneficial for several reasons. By way of example only, the vertical orientation allows the user to dry their hands in a comfortable position. Further, the vertical orientation allows the portable case to have a much smaller footprint than the typical nail care system.

It is yet another object of the invention to be able to lie the nail care system down on the floor horizontally and dry your toenails.

DETAILED DESCRIPTION OF THE INVENTION

Figure 1:
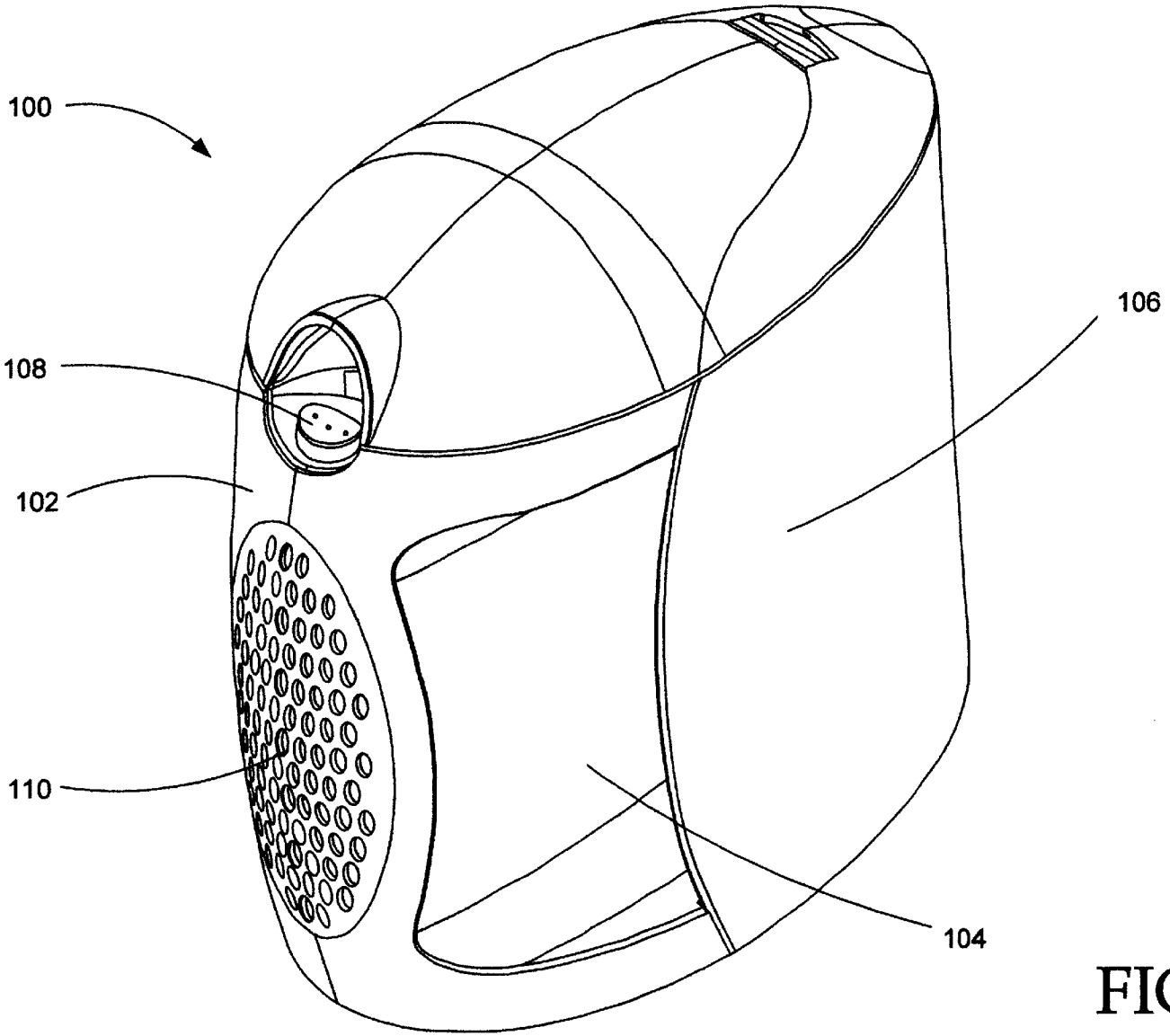
FIG. 1 is a perspective view of an embodiment of the present invention.
Figure 2:
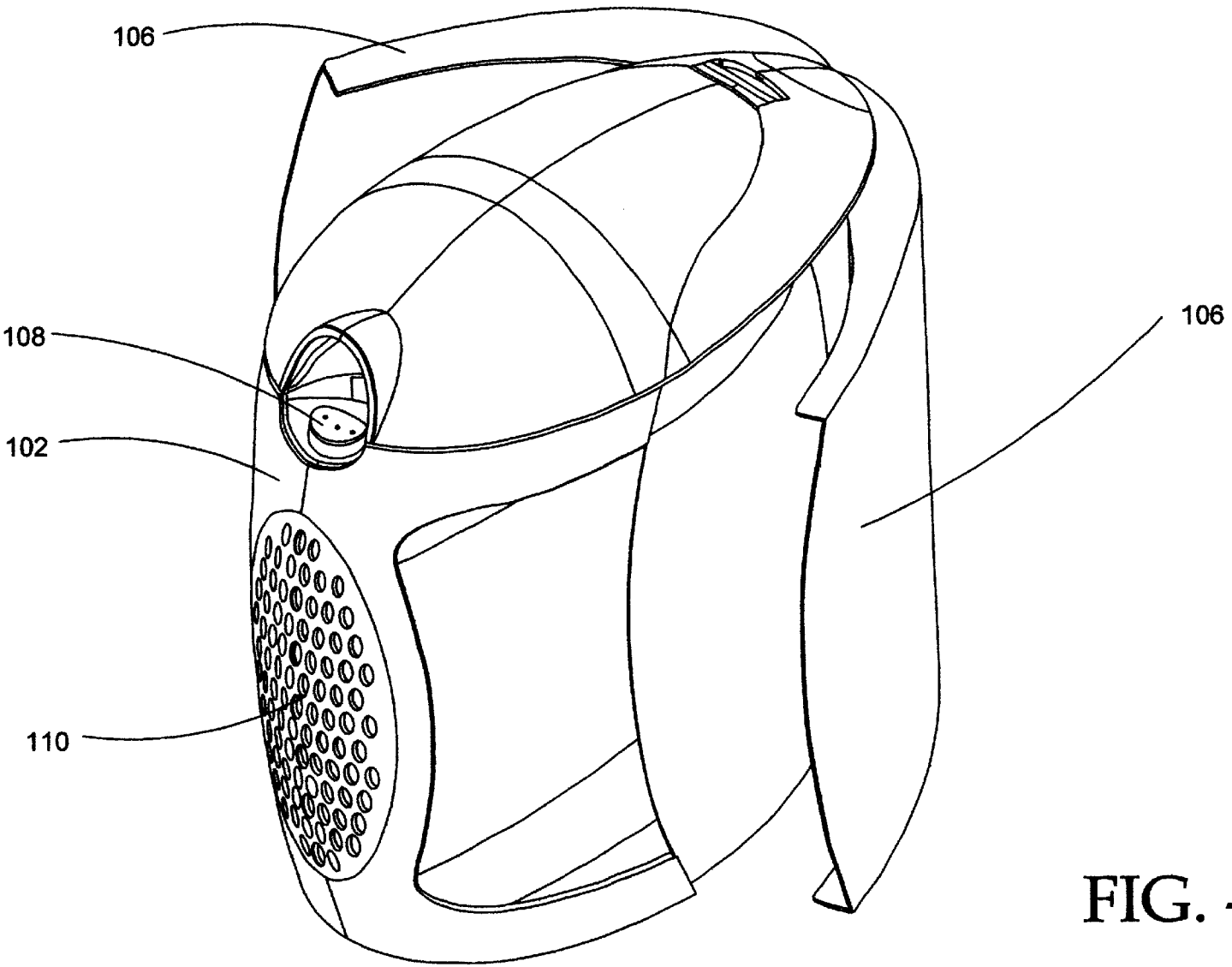
FIG. 2 is a perspective view of an embodiment of the present invention with the drying compartment doors open.
Figure 3:
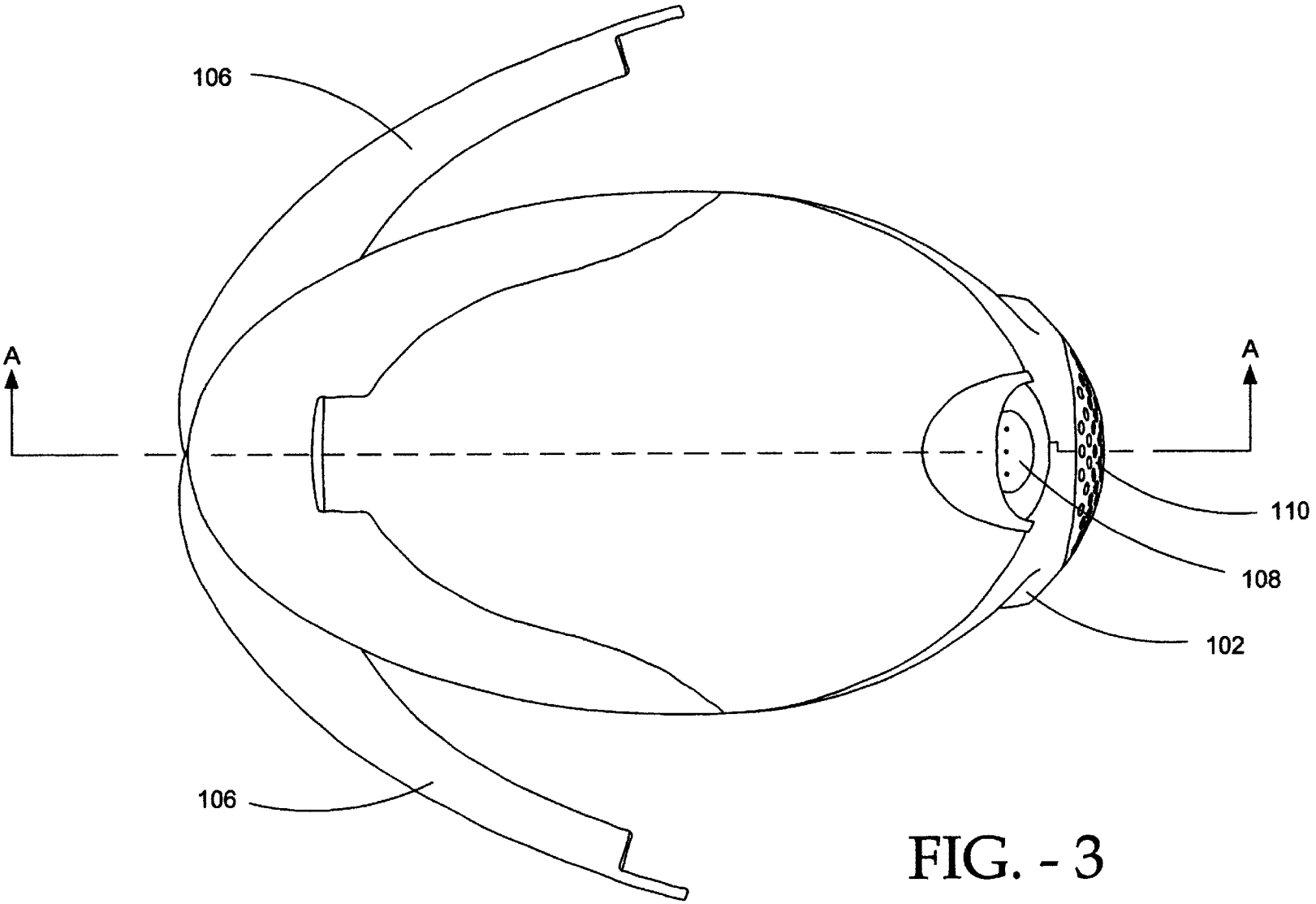
FIG. 3 is a top view of an embodiment of the present invention.

Referring to FIGS. 1–3, a nail care device 100 comprises a portable case 102, drying compartments 104 and drying compartment covers 106. The drying compartment covers 106 are pivotally mounted with the portable case 102.

After a person has painted their nails, they will need to dry their nails. Drying can be accomplished by simply allowing the nail polish to dry on the nail. However, the drying process may take several minutes to complete. To save time, a device such as a fan can be used to force air across the nails. The nail care device 100 is designed to quickly dry a person's nails or hands.

It is important to place the hands in a comfortable position so the user can leave their hands within the drying compartments 104 for the entire drying process. As shown in FIG. 1, one embodiment of the portable case 102 is an elliptical cylinder. However, one of ordinary skill in the art will appreciate that the portable case 102 may consist of other shapes such as, but not limited to, a rectangular cylinder, a circular cylinder or a pyramid. The portable case 102 is designed so that a user may comfortably place their hands in front of them while drying their hands or nails. Further, the footprint of the portable case 102 is minimized so that the portable case 102 can be stored easily and operated in a small area. Thus, the portable case 102 is preferably taller than it is wide.

Figure 4:
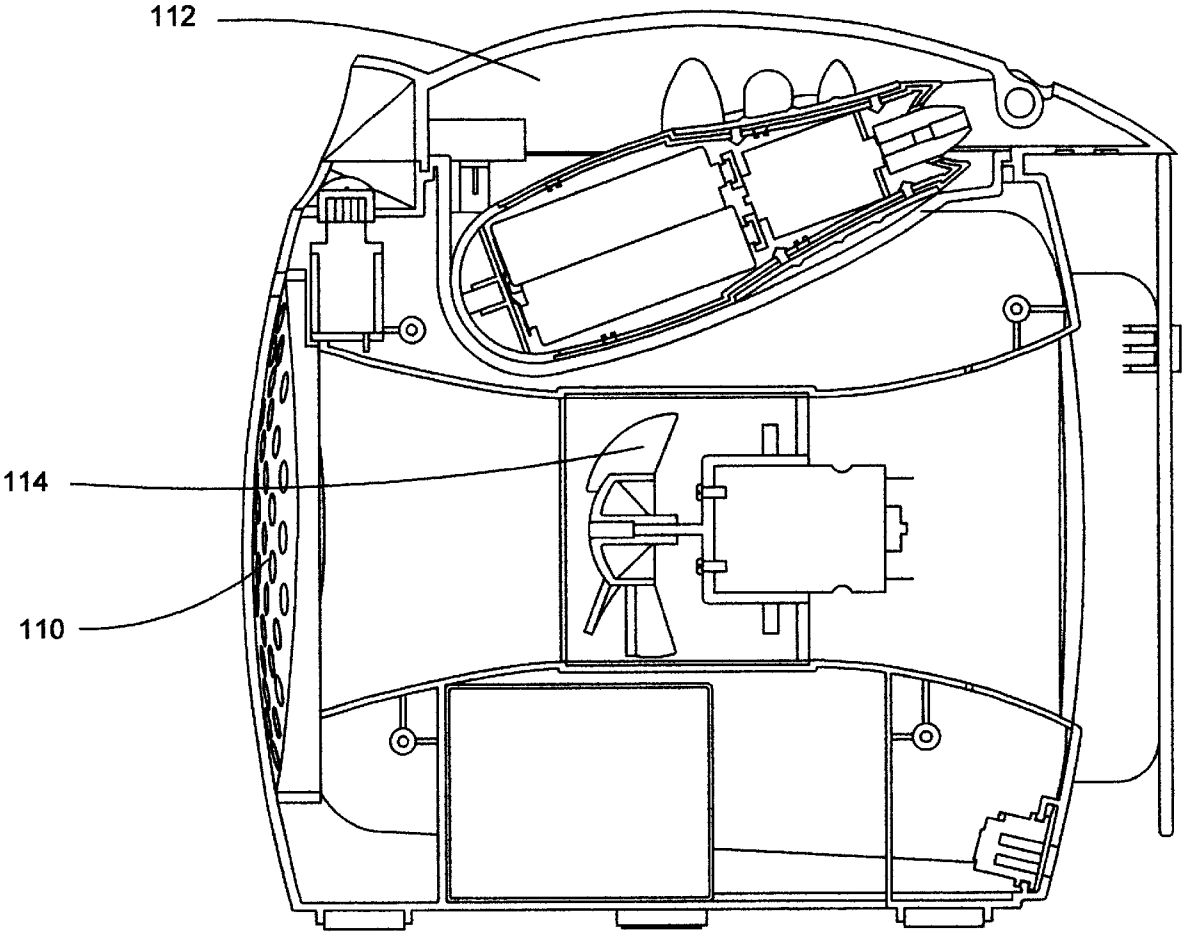
FIG. 4 is a cut-away view of the present invention along line A—A in FIG. 3.
Figure 5:
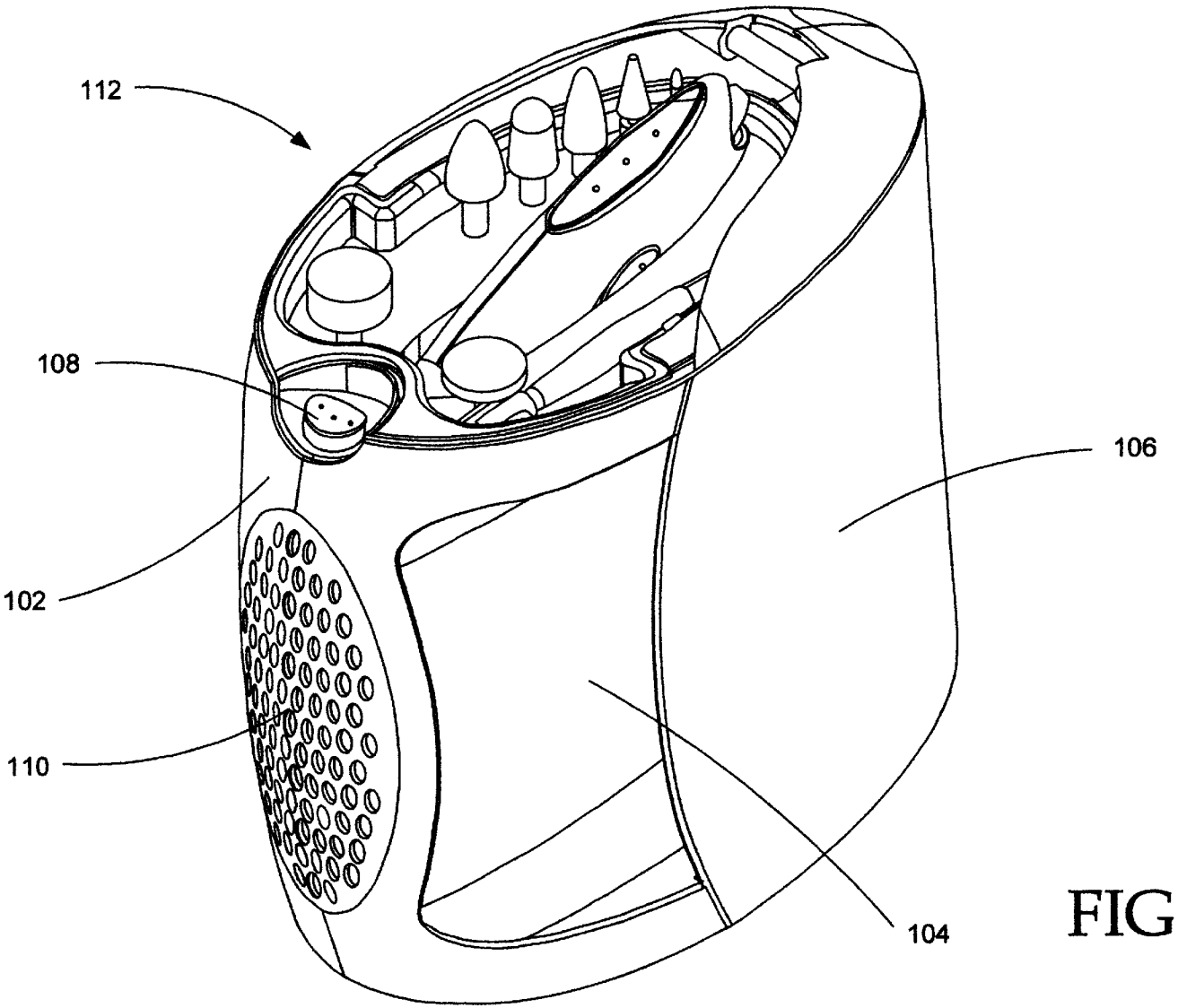
FIG. 5 is a perspective view of an embodiment of the present invention with the top partially cut away to display a tool kit.

In another embodiment of the present invention, as shown in FIGS. 4–5, the portable case 102 also contains a workstation 112 to allow a user to store nail care products. The workstation 112 eliminates the need for an additional container to store the various nail care products. The workstation 112 may store products such as, but not limited to, a buffer, a file, nail polish, and a cuticle remover. Thus, the portable case 102 will comprise a complete nail care system.

The drying compartments 104 are in a vertical orientation. The drying compartments 104 are located on opposite sides of the portable case 102 so that a user may dry their hands in a comfortable position. The vertically oriented drying compartments 104 are adapted for a user to place their hands partially into the drying compartment 104 and around the inner body of the portable case 102.

The drying compartment covers 106 are pivotally mounted with the portable case 102. The drying compartment covers 106 have a first, second and third position, thus operating as a gull-wing type door. The first position is a closed position (see FIG. 1). When the drying compartment covers 106 are in the closed position, the drying compartment covers 106 at least partially enclose the drying compartments 104. Additionally, the drying compartment covers 106 form an integral part of the portable case 102. The second position is a partially open position. The third position is the fully open position (see FIG. 2). The partially open and fully open position allow a user to create different size drying compartments 104, adjusting the drying compartments 104 to the appropriate size of their hands or feet.

To open the drying compartment covers 106, a user must pull the covers 106 outward to the second position. When the drying compartment cover 106 is in the open position, an area where a user places their hands within to dry their nails is created. The drying compartment 104 is a vertical space with the outer wall defined by the drying compartment cover 106.

However, it should be apparent that the nail care device 100 can also dry toenails. The nail care device 100 can be placed horizontally on the floor. In this orientation, one drying compartment cover 106 will face up towards the user, while the other drying compartment cover 106 will face the floor. Thus, only one of the drying compartment covers 106 can be opened at a time. The drying compartment cover 106 in contact with the floor cannot be opened while the nail care device is laying horizontally on the floor. By placing a foot into the drying compartment 104, the foot will rest comfortably on the body 102. Similar to the drying process previously described for finger nails, air will be forced over the toenails and speed up the drying process.

Prior to painting the nails, a user should first open the drying compartment covers 106 so that the nail care device 100 resembles the position illustrated in FIG. 2. After a user has painted their nails, the user should then depress the fan button 108. Pressing the fan button 108 activates the fan 114 (see FIG. 4). The fan 114 draws air through the intake vent 110 and into the drying compartment 104. When the airflow begins to flow through the drying compartment 104, a user can place their hands in front of them in a vertical position, and then into the drying compartment 104. When the nails are dry, the user can remove their hands from the drying compartment 104 and turn off the fan 114 by depressing the fan button 108. It is to be understood that as an alternative embodiment an inventive nail care device 100 can include drying compartments such as compartment 104, but without covers 106.

As stated above, this drying process will take several minutes. Thus, it is important that the person can place their hands in a comfortable position during the drying process. An example of a comfortable position is placing your hands in front of you in a vertical orientation. When your forearms are substantially horizontal to the floor, you can hold your hands in front of your body comfortably for a long period of time.

The foregoing description of preferred embodiments of the present invention has been provided for the purposes of illustration and description. It is not intended to be exhaustive or to limit the invention to the precise forms disclosed. Obviously, many modifications and variations will be apparent to the practitioner skilled in the art. The embodiments were chosen and described in order to best explain the principles of the invention and its practical application, thereby enabling others skilled in the art to understand the invention for various embodiments and with various modifications that are suited to the particular use contemplated. It is intended that the scope of the invention be defined by the following claims and their equivalence.

What is claimed is:

1. A nail care device, the device comprising:

a portable case containing a work station that stores nail care products;

a plurality of drying compartments;

a plurality of drying compartment covers; and whereby a user's hands must be oriented in a vertical position to fit within the drying compartments.

2. The device according to claim 1, whereby the drying compartment covers are pivotally mounted with the portable case.

3. The device according to claim 1, whereby the drying compartment cover has a first and a second position.

4. The device according to claim 3, whereby when the drying compartment cover is in the first position, the drying compartment cover at least partially encloses the drying compartment, and further when the cover is in the second position, the cover creates an area where a user places the user's hands within to dry the user's nails.

5. The device according to claim 1, whereby the drying compartments are in a vertical orientation on opposite sides of the portable case.

6. A nail care device, the device comprising:

a portable case containing a work station that stores nail care products;

a plurality of vertically oriented drying compartments within the portable case adapted for drying a user's nails; and a plurality of drying compartment covers connected with the portable case to selectively cover the drying compartments.

7. The device according to claim 6, whereby the drying compartment covers are pivotally mounted with the portable case, and further open to one side.

8. The device according to claim 7, whereby the drying compartment covers have a first and a second position.

9. The device according to claim 8, whereby when the drying compartment covers are in the first position, the drying compartment covers at least partially enclose the drying compartment, and further when the covers are in the second position, the covers create an area where a user places the user's hands within to dry the user's nails.

10. The device according to claim 6, whereby the drying compartments are located on opposite sides of the portable case.

11. The device according to claim 6, whereby the portable case is vertically oriented to minimize the footprint of the portable case.

12. A nail care device comprising:

a portable case containing a work station that stores nail care products;

a plurality of drying compartments;

whereby after a user has painted the user's nails, a user places the user's hands in front of the user in a vertical position, and then into the drying compartments to dry the user's nails; and whereby the drying compartments are in a vertical orientation on opposite sides of the portable case.

13. A nail care device comprising:

a portable case containing a work station that stores nail care products;

a plurality of drying compartments;

means for drying a user's nails; and whereby the drying compartments are in a vertical orientation on opposite sides of the portable case.

14. A nail care device comprising:

a portable case;

a plurality of drying compartments;

a plurality of drying compartment covers;

whereby with the covers moved to an open position, a user's hands can be oriented in a vertical position to fit within the drying compartments; and whereby the portable case further contains a work station that stores nail care products.

15. A nail care device, the device comprising:

a portable case containing a work station that stores nail care products;

a plurality of drying compartments;

a plurality of drying compartment covers;

whereby when the drying compartment covers are in a first position, the drying compartment covers at least partially enclose the drying compartment, and further when the covers are in a second position, the covers create an area where a user places the user's hands within to dry the user's nails; and whereby a user's hands must be oriented in a vertical position to fit within the drying compartments.

16. The device according to claim 15, whereby the drying compartment covers are pivotally mounted with the portable case.

17. The device according to claim 15, whereby the drying compartments are in a vertical orientation on opposite sides of the portable case.

18. The device according to claim 15, whereby the portable case is vertically oriented to minimize the footprint of the portable case.

19. A nail care device comprising:

a portable case;

a first drying compartment and a second drying compartment with the first and second drying compartments adapted to receive respective first and second hands of a user;

a first drying compartment cover and a second drying compartment cover;

wherein said first drying compartment cover is pivotally mounted to the portable case adjacent to the first drying compartment and the first drying compartment cover has a first position at least partially enclosing the first drying compartment and a second position in order to create an area adapted to receive the first hand of a user; and wherein said second drying compartment cover is pivotally mounted to the portable case adjacent to the second drying compartment and the second drying compartment cover has a first Position at least partially enclosing the second drying compartment and a second position in order to create an area adapted to receive the second hand of a user;

a work station located above the first and second drying compartments; and wherein said work station contains nail care tools.

20. A nail care device comprising:

a portable case;

a first drying compartment and a second drying compartment with the first and second drying compartments adapted to receive respective first and second hands of a user;

a first vertically oriented drying compartment cover and a second vertically oriented drying compartment cover;

wherein said first drying compartment cover forms a first wall of the case and the second drying compartment cover forms a second wall of the case which is opposite to the first wall;

wherein said first drying compartment cover is pivotally mounted to the portable case adjacent to the first drying compartment and the first drying compartment cover has a first position at least partially enclosing the first drying compartment and a second position in order to create an area adapted to receive the first hand of a user;

wherein said second drying compartment cover is pivotally mounted to the portable case adjacent to the second driving compartment and the second drying compartment cover has a first position at least partially enclosing the second drying compartment and a second position in order to create an area adapted to receive the second hand of a user; and wherein the movement of the first drying compartment cover from the first position to the second position is in an opposite direction from the movement of the second drying compartment cover from the first position to the second position;

a work station located above the first and second drying compartments; and wherein said work station contains nail care tools.

* * * * *